US008210897B2

(12) United States Patent
Hornsby et al.

(10) Patent No.: US 8,210,897 B2
(45) Date of Patent: Jul. 3, 2012

(54) INTERACTIVE INTELLIGENT TOY

(75) Inventors: James Russell Hornsby, St. Louis, MO (US); Marcellus Benson, Chesterfield, MO (US); Joseph McGowan, St. Charles, MO (US); Michael Reynolds, St. Louis, MO (US)

(73) Assignee: Cepia, LLC, St. Louis, MO (US)

( * ) Notice: Subject to any disclaimer, the term of this patent is extended or adjusted under 35 U.S.C. 154(b) by 402 days.

(21) Appl. No.: 12/540,199

(22) Filed: Aug. 12, 2009

(65) Prior Publication Data

US 2010/0261405 A1 Oct. 14, 2010

Related U.S. Application Data

(63) Continuation-in-part of application No. 12/463,391, filed on May 9, 2009, which is a continuation-in-part of application No. 12/384,993, filed on Apr. 13, 2009, now abandoned.

(51) Int. Cl.
*A63H 17/40* (2006.01)

(52) U.S. Cl. ..... 446/441; 446/275; 446/279; 446/280; 446/436; 446/444; 446/462; 446/470

(58) Field of Classification Search ..... 446/69, 446/272, 275, 279, 280, 289, 292, 436, 441, 446/444, 462, 470

See application file for complete search history.

(56) References Cited

U.S. PATENT DOCUMENTS 3,453,921 A * 7/1969 Hubiak et al. ..... 84/102
4,337,375 A * 6/1982 Freeman ..... 704/260
4,457,101 A * 7/1984 Matsushiro ..... 446/456
4,463,519 A * 8/1984 Hayes ..... 446/443
4,556,397 A 12/1985 Arad et al.
4,568,309 A * 2/1986 Maxim et al. ..... 446/465
4,752,272 A 6/1988 Karasawa
4,813,908 A 3/1989 Oikawa et al.
4,925,424 A * 5/1990 Takahashi ..... 446/175
5,019,009 A * 5/1991 Chao-Chin et al. ..... 446/437
5,127,869 A * 7/1992 Hanzawa ..... 446/397
5,478,240 A * 12/1995 Cogliano ..... 434/327
5,816,886 A * 10/1998 Cusolito ..... 446/444
6,066,025 A * 5/2000 Wisniewski ..... 446/410
6,565,407 B1 5/2003 Woolington et al.
6,695,668 B2 * 2/2004 Donahue et al. ..... 446/175

(Continued)

OTHER PUBLICATIONS

U.S. Appl. No. 29/314,493, filed Apr. 7, 2009, Hornsby.

(Continued)

*Primary Examiner* — Gene Kim
*Assistant Examiner* — Joseph B Baldori
(74) *Attorney, Agent, or Firm* — Mark C. Young; Stinson Morrison Hecker LLP

(57) ABSTRACT

The present invention is directed to an interactive intelligent toy comprising an intelligent element configured to resemble a person, animal, vehicle or other character and an environmental element configured to resemble a related environment, habitat or object. The intelligent element is adapted to perform certain preprogrammed actions upon coming into contact with or proximity to the environmental element. In one embodiment, the intelligent element is a motive component having a drive mechanism, a control mechanism and power source. The motive component is programmed to monitor and detect user and event inputs, and detect and decode embedded codes from an environmental element and perform predetermined actions or generate predetermined sounds in response. The motive component also engages with a coupling component and supplies the drive mechanism and power source for moving both the motive component and the coupling component.

5 Claims, 5 Drawing Sheets

U.S. PATENT DOCUMENTS

| | | | | |
|---|---|---|---|---|
| 7,014,525 | B2 * | 3/2006 | Abe et al. | 446/175 |
| 7,207,859 | B1 | 4/2007 | Iaconis et al. | |
| 2002/0027837 | A1 * | 3/2002 | Weber | 369/14 |
| 2002/0102910 | A1 | 8/2002 | Donahue et al. | |
| 2006/0150918 | A1 * | 7/2006 | Rowe | 119/707 |
| 2006/0183405 | A1 * | 8/2006 | Mathews | 446/456 |
| 2008/0091305 | A1 | 4/2008 | Svendsen et al. | |

OTHER PUBLICATIONS

U.S. Appl. No. 12/384,993, filed Apr. 13, 2009, Hornsby.
U.S. Appl. No. 12/790,047, filed May 28, 2010, Hornsby.
Photograph of toy "Hamusuta The Happy Hamster" (no date on product but it is believed to have been in public use for more than one year prior to Apr. 13, 2009, the priority date of the present application).
U.S. Appl. No. 12/463,391, filed May 9, 2009, Hornsby et al.
U.S. Appl. No. 12/572,610, filed Oct. 2, 2009, Hornsby et al.
U.S. Appl. No. 29/345,500, filed Oct. 16, 2009, Hornsby et al.
U.S. Appl. No. 29/345,506, filed Oct. 16, 2009, Hornsby et al.
U.S. Appl. No. 29/345,508, filed Oct. 16, 2009, Hornsby et al.
U.S. Appl. No. 29/345,513, filed Oct. 16, 2009, Hornsby et al.
U.S. Appl. No. 29/345,515, filed Oct. 16, 2009, Hornsby et al.
Iwaya Corp., Photograph of toy "Happy Chu's Day", item marked with copyright of 1997, 2007, 1 pg.
ABL Innovation Co., Ltd., Photograph of toy "Wheel Runner" (no date on product but it is believed to have been in public use for more than one year prior to Apr. 13, 2009, the priority date of the present application).
Photograph of toy "Kurukuru HamHam" (no date on product but it is believed to have been in public use for more than one year prior to Apr. 13, 2009, the priority date of the present application).
Complaint filed in the U.S. District Court of the Northern District of California, dated Mar. 10, 2011, *Jason G. Heller* v. *Cepia, LLC*. Case No. CV11-01146 in which the Assignee of the instant U.S. patent application is named as Defendant, 27 pages.
Axlon, Petster Owner's Manual and Training Guide, copyright 1985.
Tiger Electronics, Electronic Furby Instruction Manual, copyright 1999.
Sony, ERS-7 Entertainment Robot AIBO User's Guide (Basic), copyright 2003.
Hasbro, FurReal Friends Instruction Manual, copyright 2003.
Gupi Guinea Pig Instruction Manual. (admitted prior art).
Hamusuta Hamster Lil Find: Hamusuta, May 14, 2008. http://www.lilsugar.com/Hamusuta-Hamster-1624413.
Toy Quest, Tekno the Robotic Puppy Owner's Manual. (admitted prior art).
Toy Quest, Tekno Playful Pup Owner's Manual. (admitted prior art).
Serkan Toto, Sega Toys presents a new robot animal, the dream hamster, Jul. 31, 2008. http://techcrunch.com/2008/07/31/sega-toys-presents-a-new-robot-animal-the-dream-hamster/.
Joshua Fruhlinger, Sega adds Dream Hamster to its Dream Pets collection, girls say "kawaiiii!", Jul. 31, 2008. http://www.engadget.com/2008/07/31/sega-adds-dream-hamster-to-its-dream-pets-collection-girls-say/.

* cited by examiner

INTERACTIVE INTELLIGENT TOY

CROSS-REFERENCE TO RELATED APPLICATIONS

This application is a continuation-in-part of U.S. Utility application Ser. No. 12/463,391 filed May 9, 2009 entitled "Interactive Intelligent Toy," which is a continuation-in-part of and claims priority to U.S. Utility application Ser. No. 12/384,993 filed Apr. 13, 2009 now abandoned entitled "Entertainment Device". Priority to each of said prior utility applications is claimed herein pursuant to 35 U.S.C. §120, and the entireties of the disclosures of each of said prior applications are hereby specifically incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to toy entertainment devices, and more particularly to a toy having one or more intelligent elements configured to mimic the appearance of person, animal, vehicle or other character and adapted to perform specified actions upon encountering one or more environmental elements.

2. Description of Related Art

A variety of different toys are known that comprise individual objects configured to mimic the appearance of a person, animal, vehicle or other character for use in combination with objects configured to simulate an environment in which the character can perform real or imaginary life activities. For example, the Fisher Price® line of Little People® products encompasses toy people, animals and vehicles that can be manually positioned and moved in and amongst various structures such as house, barn or castle. Battery powered robotic toy objects are also known that can operate in conjunction with environmental elements, such as battery operated cars configured to run on a track, battery operated baby dolls programmed to engage or interact with a toy baby bottle or pacifier, and robotic pets programmed to make movements or noises that simulate a real life animal.

While robotic or battery operated toys are more life-like than non-powered objects, the robotic toys that exist in the toy industry to date are limited in their ability to provide a real life experience, because most of these robotic toys require the use of a remote control or specific commands from a child to operate. The toys do not operate "on their own" outside the control of the child.

One exemplary embodiment of the present invention is directed to an intelligent toy hamster. Real hamsters typically live in habitats comprising tubes, tunnels, and the like. The habitats are assembled and expanded upon with accessories such as hamster balls or exercise wheels to enhance the entertainment value of the pet. The pets that dwell in these habitats move about under their own will and are very enjoyable to watch. Unfortunately, pet hamsters require a great amount of maintenance. For instance, pet hamsters require food and water, and generate waste that needs to be cleaned-up regularly. It would therefore be advantageous to provide a toy hamster that supplied the same entertainment as a real hamster but without the maintenance requirements. Existing toy pets that utilize a remote control or respond to specific commands of the child do not provide the complete experience of a real pet that has a "mind of its own."

BRIEF SUMMARY OF THE INVENTION

The present invention is directed to an interactive intelligent toy that provides the appearance and experience of a person, animal, vehicle, or other character moving in, and/or interacting with, its environment or habitat on its own. The toy comprises one or more intelligent elements configured to simulate a person, animal, vehicle or other character and adapted to perform certain activities in conjunction with one or more environmental elements. In one embodiment, the intelligent element is programmed or adapted to perform certain activities in response to an environmental element. For example, the intelligent element (simulating a car) may generate a noise (a honking horn) upon passing a portion of an environmental element (simulating a house). In another embodiment, the intelligent element is programmed or adapted to provide the means necessary for the environmental element to perform certain activities. For example, the intelligent element (simulating a person) may provide the power and control mechanisms needed to move an environmental elemental (simulating a car). The invention therefore provides a simulated character that appears to have a mind of its own in operating within a certain environment. Furthermore, given that the intelligent element is able to supply the means (drive mechanism, control mechanism and power source) to enable other elements to perform actions, the cost of the toy can be minimized while providing a large variety of different activities and the ability to expand to new environments and activities.

In one embodiment, the intelligent element comprises a motive component. The motive component has a drive mechanism for moving the element, a control mechanism that directs the motive component to perform certain activities such as moving, making noise, changing color or generating light based upon its interaction with one or more environmental elements, and a power source to power the drive mechanism and control mechanism. The environmental elements may comprise one or more pathway components on which the motive component travels and one or more coupling components with which the motive component engages to perform certain activities in conjunction with the coupling components.

As to operation with the pathway components, codes may be embedded or otherwise presented at different locations along the pathway component. The control mechanism comprises sensors that identify the codes and direct the motive component to perform a specified activity in response to the code. This activity could be a certain pre-programmed movement in response to the code or the generation of a specified sound, color change, or light, or other activity responsive to the code.

As to operation with the coupling components, the coupling component may be shaped to resemble the appearance of a moving object such as a motorized vehicle, train, plane, helicopter, skateboard, surfboard, or bicycle. In this embodiment, the coupling component does not include its own drive mechanism, power source, or other control mechanism. The motive component and coupling component are configured to engage in a manner such that the drive mechanism of the motive component can be utilized to move both the motive and coupling components combined. The motive component may instead or in addition be configured to engage the coupling component and perform a different activity such as making a noise while the two components are engaged.

It is noted that the intelligent element need not be a motive component in order to perform in accordance with the present invention. For instance, the coupling component may include its own drive mechanism, but not include a power source or control mechanism. In this instance, the intelligent element is configured to engage the coupling component in such a way as to provide power to the coupling component so that the coupling component can utilize its own drive mechanism to move the coupling component in combination with the intelligent element. In addition, the intelligent element may be configured to engage a coupling component so as to provide power to other equipment on the coupling component such as lights or sound generators. In this fashion, the intelligent element serves as a power source that, when engaged with the coupling component, provides power to the coupling component to operate and perform particular activities. The intelligent element may also provide the control mechanism for a coupling component. For example, a coupling component may have a drive mechanism and may also have a separate power source such as batteries, but may not have any circuitry in order to control the drive mechanism or power source. The intelligent element may be configured to engage the coupling component in such a manner that the control mechanism of the intelligent element can control operation of the drive mechanism and power source contained within the coupling component.

It is noted that more than one intelligent element may be provided wherein each intelligent element is programmed to perform different actions in response to the codes contained within a pathway component or engagement with a coupling component. In this manner, the different intelligent elements appear to have a different personality because they respond differently to the same environmental elements. This creates an even more realistic, real-life experience for the child wherein different intelligent elements have different personalities and reactions to the same environmental stimulus. For example, a first hamster toy, Mr. Squiggles, may laugh "ha ha ha" whenever it passes over the coding on a pathway component at the top of a slide, whereas a second hamster toy, Yum Yums, may yell "yahoo" upon passing over the coding at the top of the slide. Similarly, Mr. Squiggles may be programmed to move forward in a straight line when engaging a skateboard coupling component, while Yum Yums may be programmed to move in a circle eight configuration when engaging the surfboard. Furthermore, a given intelligent element does not always perform the same action in response to the same stimulus. Unlike track-based toys known in the prior art, which provide only for predetermined, entirely predictable movement, or radio-controlled or tethered toys which rely on user input to determine movement and actions, the intelligent elements of the present invention provide the appearance of intelligent, thinking animals with self-decision capability and free-will that perform varied, sometimes seemingly random, responses to the environment it encounters. As explained in more detail below, the same intelligent element, encountering the same code in a pathway will not always respond in the same, predictable manner. Thus, the appearance and movement of the intelligent elements is realistic and generally unpredictable.

In an exemplary embodiment, the interactive intelligent toy comprises a motive component enclosed by a cover resembling a hamster with fur coat, eyes, ears, mouth, nose, and whiskers (a "motive hamster"), a pathway component on which the motive hamster can travel, and at least one coupling component configured to releaseably engage with the motive hamster. The motive hamster includes a drive mechanism to enable movement, a control mechanism operable to control the drive mechanism, monitor and detect user and event inputs, detect and decode embedded codes from a pathway component and perform predetermined actions or generate predetermined sounds in response to the codes, and a power source to supply power to the drive mechanism upon the command of the control mechanism and supply power to the control mechanism for its operation. The motive hamster moves along and through the pathway component having one or more embedded codes detectable by the control mechanism. The embedded codes provide information to the control mechanism to direct desired movement of the motive hamster or to direct other desired action such as generating a predetermined sound.

The coupling component is configured to mimic the appearance of a car, skateboard, surfboard, or other mobile object. The component does not itself have a drive mechanism, power source, or control mechanism. Instead, the motive hamster is configured to engage with the coupling component in such a way as to permit the drive mechanism, power source, and control mechanism of the motive hamster to drive movement of both the hamster and coupling component.

In use, as the motive hamster moves through the various sections of pathway, encountering "bump codes" embedded in the pathway while the control mechanism decodes the codes and directs the motive component to perform specific actions, move in specific ways, and generate specific sounds in response to the detected code. Thus, the appearance of the hamster moving through the pathway is that of a real pet hamster exploring and interacting with its environment and habitat. The hamster also can, from time-to-time, encounter and engage with a coupling component such as an object configured to mimic the appearance of a car or a surfboard and, upon coupling with the component, continue moving in combination with the component so as to appear to be driving the car or riding the surfboard.

In additional aspects of the invention, the motive component includes user operable switches to interact with the hamster, and operation in a free run or explore mode independent of the pathway component. Various alternative embodiments are described herein, and other variations and configurations are anticipated by the present invention. For example, while the invention is described herein primarily with respect to a configuration resembling a pet hamster, other configurations may be used, such as other pets (e.g., dogs, cats, mice, etc.), people or characters (e.g., father, mother, child, fireman, police man, fairy, witch), or vehicles (e.g., fire trucks, police cars, etc.) or any other desired configuration.

BRIEF DESCRIPTION OF THE DRAWINGS

The present invention will be described in greater detail in the following detailed description of the invention with reference to the accompanying drawings that form a part hereof, in which.

DETAILED DESCRIPTION OF EXEMPLARY EMBODIMENTS

An interactive intelligent toy in accordance with an exemplary embodiment of the present invention is depicted in FIGS. 1-10. While the invention will be described in detail herein below with reference to this exemplary embodiment and alternative embodiments, it should be understood that the invention is not limited to the specific configurations shown and describe in these embodiments. Rather, one skilled in the art will appreciate that a variety of configurations may be implemented in accordance with the present invention.

Looking first to FIGS. 1-3 and 8-10, an interactive intelligent toy in accordance with an exemplary embodiment of the present invention comprises: (1) an intelligent motive component 10 (FIG. 1) having a drive mechanism, control circuitry operable to control the drive mechanism, monitor and detect user and event inputs, and detect and decode embedded codes from a pathway and perform predetermined actions or generate predetermined sounds in response, and a power source; (2) a pathway component 12 (FIG. 3) having one or more embedded codes detectable by the motive component, the embedded codes providing information to the motive component to direct desired action of the motive component; and (3) a coupling component 82 (FIGS. 8-10) configured to mimic the appearance of a car and releasably engage with motive component 10 in a manner to permit the drive mechanism of motive component 10 to move coupling component 82 in combination with motive component 10.

Figure 1:
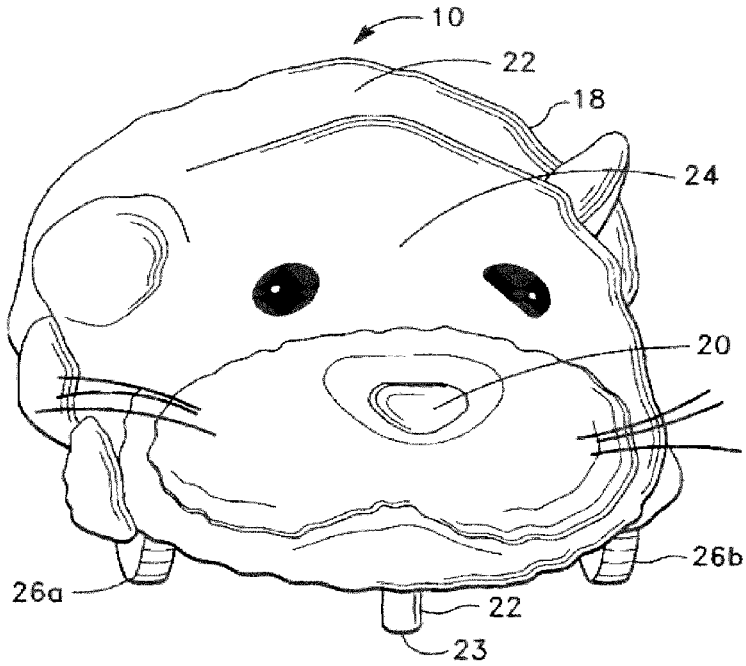
FIG. 1 is a perspective view of an intelligent motive hamster in accordance with an exemplary embodiment of the present invention.
Figure 2:
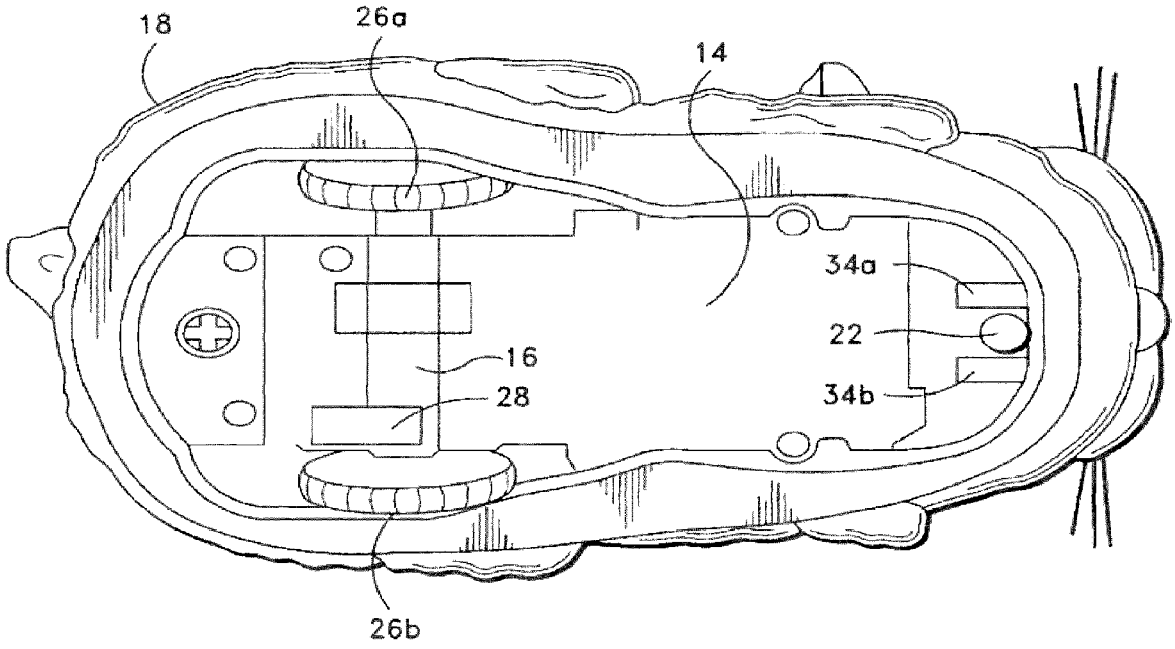
FIG. 2 is a bottom view of the motive hamster of FIG. 1.
Figure 3:
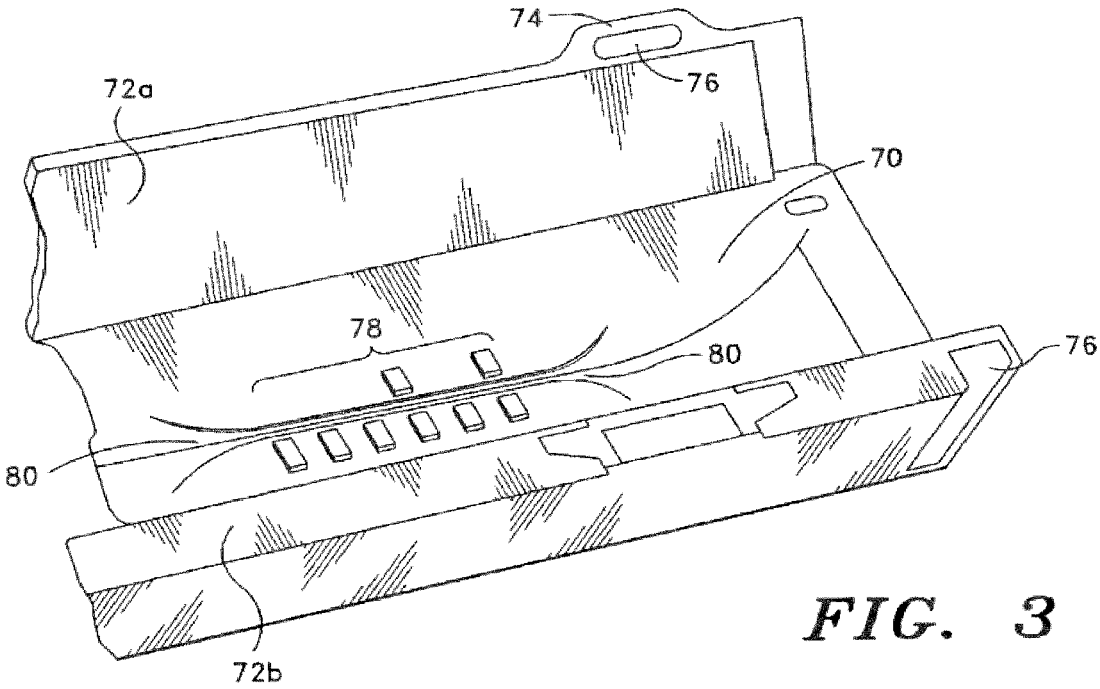
FIG. 3 is an enlarged partial view of a portion of a pathway component in accordance with an exemplary embodiment of the present invention showing a bump code comprising a series of raised bump code formed in the pathway.

As depicted in FIGS. 1-3, motive component 10 and pathway component 12 preferably resemble a pet hamster and its habitat, respectively, with the interactive intelligent toy of the present invention allowing one or more pathway components and one or more motive components to be configured, assembled and used in various combinations to simulate the environment, habitat and actions of an actual pet hamster. The control circuitry communicates with various switches and sensors on the motive component to detect user or environment/habitat inputs and provides apparent intelligent control to the toy, for example, by generating sounds or actions in response to various detected embedded codes in the pathway and by altering the movement of the motive component in response to a detected obstacle. The overall effect of the combined intelligent motive component and pathway component is that of an intelligent animal (e.g., a hamster) exploring and interacting with its habitat and environment.

Figure 8:
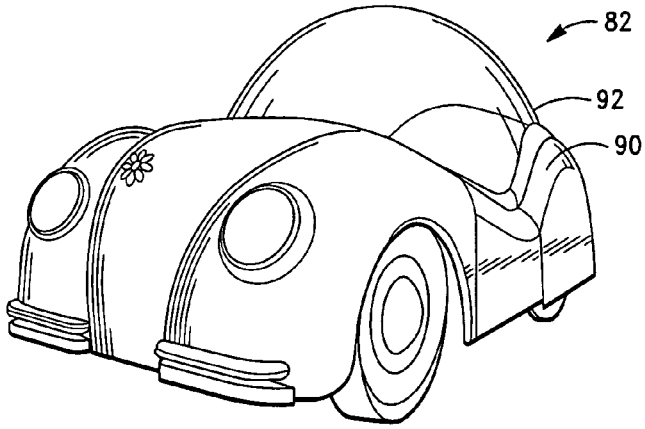
FIG. 8 is a perspective view of a coupling component in accordance with an exemplary embodiment of the present invention configured to mimic a car.
Figure 9:
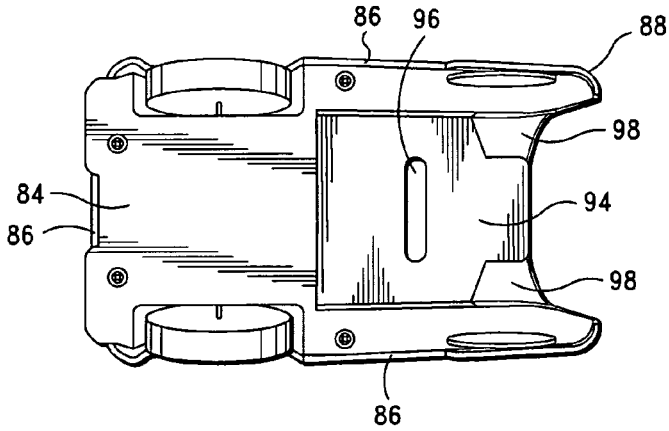
FIG. 9 is a bottom view of the coupling component of FIG. 8.
Figure 10:
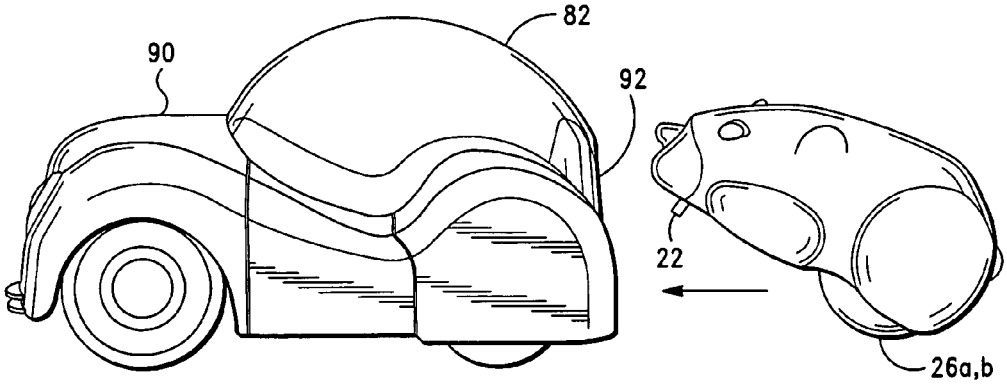
FIG. 10 is an exploded view of the hamster element of FIG. 1 engaged with the coupling component of FIG. 8.

As depicted in FIGS. 8-10, coupling component 82 resembles a car wherein coupling component 82 is configured to permit motive component 10 to drive onto the coupling component and releasably engage the coupling component in a manner to permit the drive mechanism of motive component 10 to move both the coupling component 82 and motive component 10 while engaged.

Looking to FIGS. 1 and 2, motive component 10 comprises a chassis 14, which houses control circuitry and batteries (as described in more detail below) and supports a drive mechanism 16, with a decorative cover 18 positioned over and covering the top portion of the chassis.

Cover

As best seen in FIG. 1, cover 18 is configured to resemble a pet hamster having a fur coat with eyes, ears, nose, and whiskers. Control switches (described in more detail below) in communication with the control circuitry are positioned on or embedded under cover 18 such that the switches can be activated through the cover by pressure applied to the corresponding area of the cover. Preferably, the control switches are activated by a user pressing the corresponding area of the cover or by the action of the motive component bumping into an object or obstacle during movement in its habitat or environment. Operation or activation of each control switch provides a signal to the control circuitry to perform a specific action.

For example, cover 16 preferably includes a bump sensor switch located under the nose 20 of the hamster operable to detect the front of the motive component bumping into an obstacle when the motive component is in motion. That same switch also serves as a "try me" switch activated by a user to initiate a demonstration mode when the toy is packaged for display or sale. A control switch positioned on the back 22 of the hamster is preferably operable to wake the toy from a "sleep mode" and to turn on and off an "explore" mode, with a control switch positioned at the head 24 of the hamster preferably operable to wake the toy from sleep mode, turn off the explore mode, and to generate predetermined sounds simulating cooing and/or speech. As will be described in more detail below, the control circuitry of the motive component is operable to detect activation of the various control switches and to command the motive component to perform various actions in response to activation of the control switches, or to various combinations of the control switches.

Chassis

Looking to FIG. 2, chassis 14 includes a drive mechanism 16 positioned near the rear of the chassis operable to transport motive component 10 in forward or reverse directions, with a glide post 22 positioned at the center front portion of the chassis that functions: (1) to guide the motive component to follow a groove or raceway in a pathway or surface such as a channel or path formed to guide the motive component between a series of raised bumps formed in the pathway defining a bump code (as will be described in more detail below); (2) to elevate the front portion of the motive component from a surface so that the cover 18 does not drag and impede the travel of the motive component; and (3) to provide a contact surface 23 allowing the motive component to glide across a smooth surface. Glide post 22 also allows the motive component to make sharp turns or pivot, particularly when turning in reverse as described below.

Drive mechanism 16 preferably comprises a direct current motor in mechanical communication with wheels 26*a*, 26*b* so that rotation of the motor rotates the wheels to transport the motive component forward or backward. The motor is in electrical communication with the control circuitry which provides power to the motor, with the capability to switch the polarity of the command signal to drive the motor in either a forward or reverse direction.

A kickstand 28 coupled to the drive mechanism is positioned near wheel 26*b*, and is operable to extend when the drive mechanism rotates in a first direction and to retract when the drive mechanism rotates in a second direction. When the kickstand extends, it contacts the surface to raise the side of chassis 14 near wheel 26*b* so that wheel 26*b* is lifted slightly or entirely off of the surface. Thus, activation of the kickstand effectively disables the associated wheel so that only one wheel is engaged with the surface, causing the motive component to turn in a sharp arc. Preferably, the kickstand extends when the drive mechanism rotates in reverse, and retracts when the drive mechanism rotates forward so that the motive component turns in a sharp arc in reverse. Most preferably, wheels 26*a* and 26*b* are approximately the same size so that forward rotation of the motor drives each wheel equally such that the motive component moves in a substantially straight path forward.

Figure 7:
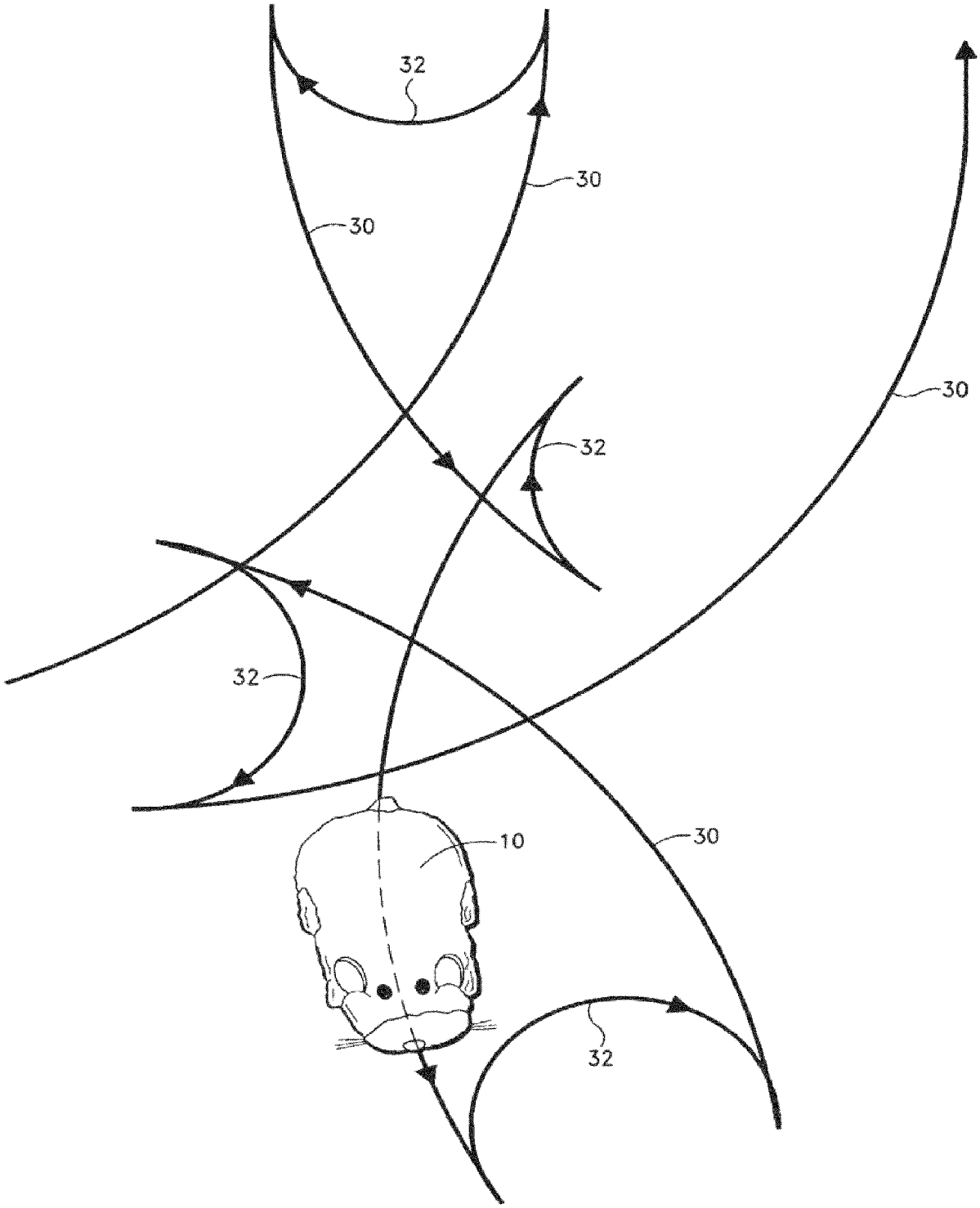
FIG. 7 is a diagram of a forward and reverse motion pattern of the motive hamster of FIG. 1.

Other arrangements of the drive mechanism, wheels, and kickstand are contemplated by the present invention. For example, wheel 26*a* could be a slightly larger diameter than wheel 26*b* so that forward or reverse motion of the motive component would be in gradual arc rather than in a straight line. As depicted in FIG. 7, in conjunction with the kickstand as just described, such a configuration would result in motive component 10 moving in a gradually arced path 30 when moving in a forward direction, and moving in a sharply arced path 32 when moving in reverse. The distance moved in each of the forward and reverse directions is controlled by predetermined timing intervals in the control circuitry, by random timing intervals in the control circuitry, by detection of obstacles thorough a control switch (e.g., the nose bump switch) as previously described, or combinations thereof.

As seen in FIG. 7, the overall effect of the combination of relatively short forward and reverse movement of the motive component, with the direction changes, is that of a hamster exploring its habitat. Other variations in the combination of wheel size, kickstand operation, and timing of forward and reverse movement will be apparent to those skilled in the art and are within the scope of the present invention. For example, a slip gear, kickout gear, or sloppy axle could be used in the drive mechanism instead of the kickstand to provide sharp turning of the motive component in a particular direction. Or, separate drive motors for each wheel or adjustable gearing to vary the drive ratio of each wheel could be implemented.

Looking again to FIG. 2, bump code sensors 34*a*, 34*b*, positioned on opposite sides of glide pin 22, are operable to detect a series of bumps in the pathway defining a "bump code," the bump code being decoded by the control circuitry and defining a desired action of the motive component as will be described in more detail below. Preferably bump code sensors 34*a*, 34*b* are mechanical spring-loaded pushbutton type switches operable to actuate as they arc depressed by a series of raised bumps passing under and contacting the sensors as the chassis is transported across the series of bumps. Bump code sensors 34*a*, 34*b* are in electrical communication with the control circuitry described below, which is operable to decode the sequence/series of bumps detected into a desired action of the motive component.

Preferably, bump code sensors 34*a*, 34*b* are inexpensive mechanical type switches that interface to the control circuitry with no additional power requirements. However, other types of sensors may be used (with corresponding changes to the type of codes implemented in the pathway component) in accordance with the present invention. For example, sensors 34*a*, 34*b* could be infrared (IR) readers operable to detect a corresponding bar code label on the pathway component. Or, the sensors could be a radio frequency identification transponder operable to activate and capture data from an RFID tag embedded or otherwise placed in the pathway component.

Control Circuitry

Figure 5:
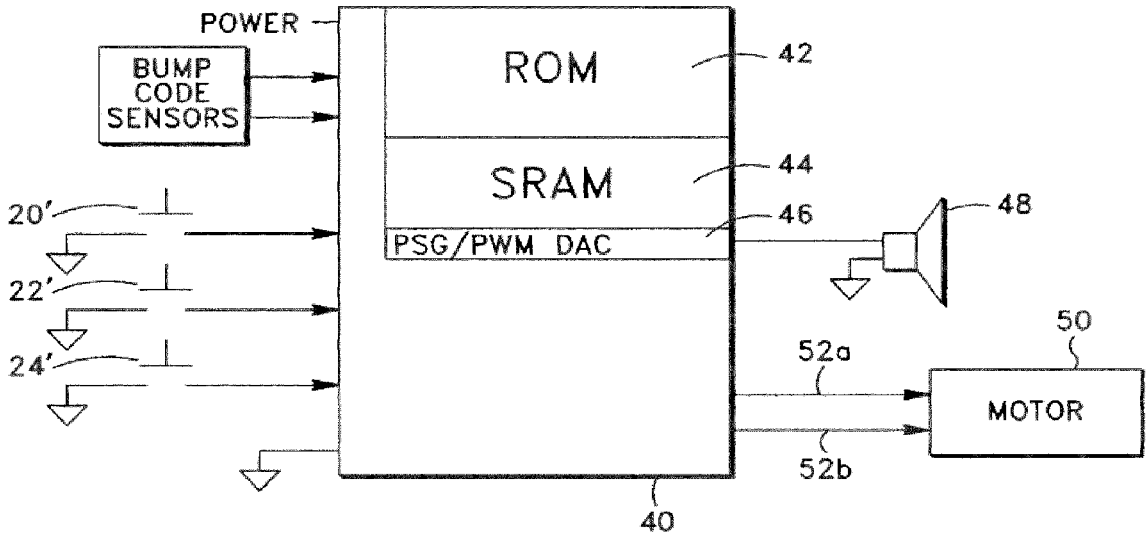
FIG. 5 is a block diagram of the control mechanism utilized in the hamster of FIG. 1.

Turning to FIG. 5, a block diagram of an exemplary embodiment of control circuitry of the interactive intelligent toy is depicted. The control circuitry includes a microcontroller 40 operable to execute programmed instructions, to monitor inputs and control outputs according to those programmed instructions, and to generate sound signals. Micro controller 40 may be any microcontroller known in the art having the capabilities to perform the functions described herein. Preferably, microcontroller 40 includes onboard Read Only Memory (ROM) 42, Static Random Access Memory (SRAM) 44, and a Programmable Sound Generator (PSG) having a Pulse Width Modulated (PWM) Digital to Analog Converter (DAC) 46.

Read Only Memory (ROM) 42 stores the program code and instruction that are executed by the microcontroller which defines the operation of the motive component. ROM 42 also stores the audio data files used by the microcontroller to generate sounds. Preferably the audio data files are in ".wav" format, although other audio file formats known in the art may equally be used with appropriate decoding software running on the microcontroller. ROM 42 may also store any other programming, audio, data, or configuration parameters as required. As is known in the art, ROM 42 provides essentially permanent storage of the program code, audio data files, and other data or instructions stored thereon, retaining that data even when no power is applied to the ROM. Static Random Access Memory (SRAM) 44 provides temporary storage for data and variables generated by and used by the microcontroller as the program executes. As is known in the art, SRAM 44 stores data only when power is applied.

Programmable Sound Generator (PSG) and Pulse Width Modulated (PWM) Digital to Analog Converter (DAC) 46 provides the capability to convert audio data to an electrical signal, as is known in the art. The electrical signal is transmitted to speaker 48 which converts the electrical signal to an acoustical wave, preferably in the form of a human-perceptible sound. Speaker 48 is preferably a miniature Mylar speaker positioned on the chassis 14 of the motive component as described above. Of course other types of speaker devices, such as piezoelectric transducers, may also be used.

Microcontroller 40 controls motor 50 through lines 52*a*, 52*bb* that provide a voltage and current output to the motor. Motor 50 is the direct current motor portion of the drive mechanism 16 portion of the motive component as described above. Microcontroller 40 is operable to switch the polarity of the signals provided through lines 52*a*, 52*b* to drive the motor in either the forward or reverse directions to control the movement of the motive component.

Switches 20', 22', and 24' (corresponding to the nose, back, and head portions of the cover 18 as described above) provide inputs to microcontroller 40 indicating operator input or input due to contact of the motive component with an obstacle. For example, activation of switch 20' corresponds to the nose of the motive component, indicating that the motive component has bumped into an obstacle. Activation of switch 22' or 24' corresponds to the back and head portions, respectively of the cover 18, indicating user interaction with those areas. For example, activation of switch 24' (corresponding to the head portion of the hamster) indicates that a user is touching or stroking the hamster's head. In response, microcontroller 40 activates a cooing or voice audio file to produce that sound through speaker 48. From the user's perspective, stroking the hamster's head causes it to coo. Similarly, the other input switches cause the microcontroller to perform specific actions. Activation of the nose switch 20' indicates that the hamster has bumped into an obstacle. In response, the microcontroller reverses the direction of motor 50 to change the direction the hamster is traveling. It will be apparent to those skilled in the art that various combinations of inputs thus could instigate various actions by the microcontroller to control the movement and/or sound of the motive component/hamster.

Bump code sensors (corresponding to bump code sensors 34*a*, 34*b* described above) provide inputs to the microcontroller 40 and correspond to the bump code sensors located on either side of the glide pin 22 on the chassis 14 as described above. Microcontroller 40 is operable to detect the inputs from the bump code sensors and to decode the various bit patterns detected according the bump code protocol described below. Upon detecting and decoding a bump code, the microcontroller performs specific actions according to that bump code. Power to the microcontroller is preferably provided by three AAA size batteries positioned on the top side of chassis 14 described above. Of course other power sources, such as rechargeable cells or batteries and storage capacitors may also be used.

Microcontroller 40 is preferably a single integrated circuit (IC) having all of the functionality of the ROM 42, SRAM 44, and PSG/PWM DAC 46 on-board and built-in. However, other arrangements, configurations, and variations are within the scope of the present invention. For example, the ROM, SRAM, and DAC could each be discrete components controlled by a discrete microprocessor IC. Or the PSG/PWM DAC and speaker functionality could be built or combined into a separate device.

Pathway Component

Figure 4:
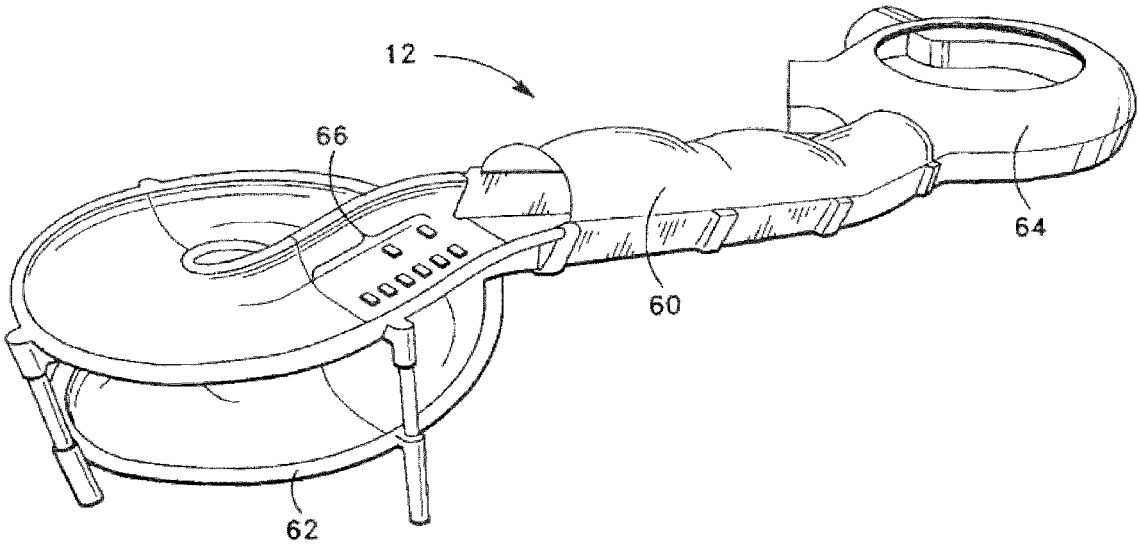
FIG. 4 is a perspective view of a plurality of pathway components in accordance with an exemplary embodiment of the present invention.

Looking to FIGS. 3 and 4, pathway component 12 comprises one or more sections of pathway configured as a tube or tunnel 60, a circular slide 62, or room 64. As described above, pathway components may likewise be configured or designed as any desired configuration corresponding to hamster habitat pieces and devices as used with an actual pet hamster, such as exercise wheels, or may be configured and designed as other whimsical or toy devices, such as cars or trucks. Thus, it should be understood that the pathway components described and depicted in the exemplary embodiments described herein are exemplary in nature, and not limiting of the scope of the present invention. Unlike tracks or tethers used with toy motorized vehicles as known in the prior art, the pathway component does not rigidly guide the motive component in a predetermined course, rather it generally directs the motive component, allowing the motive component to apparently intelligently explore its environment in a manner similar to that of a living animal.

Looking to FIG. 3, a close-up partial view of a portion of an exemplary pathway component shows that the pathway component includes a floor surface 70 with walls 72*a*, 72*b* extending upwardly from opposite sides of the floor to form a semi-enclosed pathway. Viewed in conjunction with the motive component described previously, it can be seen that the motive component can move along the floor surface 70 of the pathway, guided and contained by the walls 72*a*, 72*b* on either side. Thus, looking to FIG. 4, it can be seen that the motive component can move along various configurations of the pathway component, such as a circular slide 62 or a tunnel or tube 64.

Looking back to FIG. 3, the pathway component includes one or more tabs 74 and receptacles 76 configured to interlock with corresponding tabs and receptacles similarly positioned on additional pathway components so that multiple pathway components can be connected together to form a complete habitat. As seen in FIG. 4, various pathway components (circular slide 62, tunnel 60, and room 64) are connected together in an exemplary habitat.

The pathway component includes a bump code 78, comprising a series of raised bumps formed in the floor surface 70, with guide recesses 80 formed in the floor surface at opposite ends of the bump code to direct the glide pin 22 of the motive component between the two rows of raised bumps. Thus, the bump sensors 34*a*, 34*b* of the motive component are each aligned with the corresponding rows of bumps to detect those bumps as the motive component is transported past the bump code, activating bump sensors 34*a*, 34*b* as previously described.

Thus, the pathway components not only generally direct the motive component, but also align the motive component to detect the bump codes formed in the pathway. While the bump codes are preferably raised bumps formed in the pathway, it should be understood that other detectable codes could be used within the scope of the present invention. For example, the codes in the pathway could be bar codes detectable by a corresponding IR sensor on the motive component, or the codes could be RFID tags detectable by a corresponding RFID transponder on the motive component.

Looking to FIG. 4, it should be apparent that pathway component room 64 does not have a floor having bump codes, but instead acts as a connector for multiple tubes, tunnels, or other pathway components which preferably themselves include a bump code to direct the motive component as it enters and/or exits the room.

Bump Code Protocol

Figure 6:
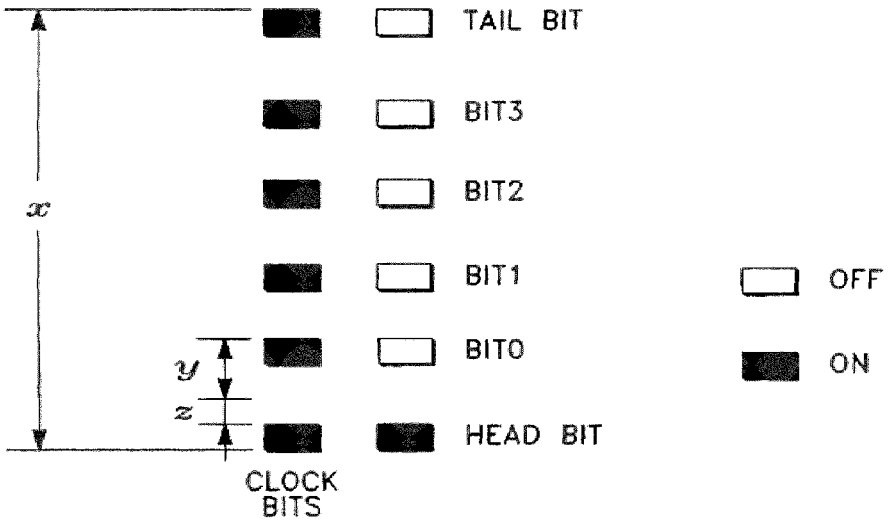
FIG. 6 is a diagram of the encoding protocol of the bump pattern formed in the pathway component.

Turning to FIG. 6, an exemplary arrangement of the bump code pattern and protocol is depicted. The bump code is arranged in a 2 by 6 bit pattern, i.e., two rows, each having six bits. In the exemplary pattern shown, one row serves as a clock bit row for the first bump code sensor (e.g., bump sensor 34*a*, indicating when that sensor has contacted the clock bit bump) so that the control circuitry can then read the data from the second sensor (e.g., bump sensor 34*b*) by microcontroller 40 decoding the input data as described above. The spacing of the bits of the bump code pattern is preferably such that the overall length x of the pattern is at least 42 millimeters, with the total distance between the trailing edges of successive bits y+z at least 6 millimeters, and a minimum of 1 millimeter z between the trailing edge and leading edge of successive bits.

As depicted in FIG. 6, the 2 by 6 bit pattern with clock bits provides four data bits (bit 0, bit 1, bit 2, and bit 3), which correspond to sixteen unique codes that can be encoded by the bump code pattern. Those sixteen codes are detected and decoded by the control circuitry to perform various actions and generate various sounds. For example, looking to FIG. 4, a motive component/hamster traveling up tube 60 to circular slide 62 encounters a bump code 66 that preferably indicates that the pathway component is a circular slide. The bump code is detected and decoded by the control circuitry which then performs the actions associated with the circular slide bump code, e.g., generate a "wheee" sound that plays through speaker 42 as the hamster travels down the slide.

It should be understood that the bump code as described may be bidirectional, such that a series of bumps that provide a specific bit pattern in one direction may, and likely will, provide a different bit pattern when read in a different direction. Thus, for example, a single bump code located on a portion of pathway adjacent a room section may provide one code when the motive component passes over the bump code upon entering the room (i.e., an entrance code) and may provide another code when the motive component passes over that same bump code upon exiting the room (i.e., an exit code). It should also be understood that the control circuitry of the motive component may ignore specific codes or undefined codes, or that the exemplary bit pattern as just described may be expanded to provide more bits and thus a correspondingly greater number of available codes.

It should also be apparent that various bump codes to indicate various pathway components can be implemented, for example a code indicating an exercise wheel component would instigate an exercise wheel sound, with the motive component moving on that wheel for a predetermined time, or entering a game room pathway component would instigate sounds corresponding to playing games, and so forth. It should also be understood that the actions performed by the motive component in response to a specific code need not be the same each time that particular code is encountered. For example, the control circuitry may have a list of numerous "game room" responses so that each time the motive component enters a game room a different sound and/or movement response is selected from the list (either sequentially or randomly) and that response is commanded by the control circuitry. Thus, the actions of the motive component appear more intelligent and random than if only a single response were provided.

Furthermore, the control circuitry is preferably programmed to ignore unrecognized codes (i.e., take no action upon detecting an unrecognized code) so that any errors or interruptions in detecting a code will be ignored. For example, slippage of the wheels of the motive component as the bump sensors are traversing an embedded code could disrupt the timing of the bit pattern of the embedded code—resulting in an erroneous bit pattern and detected code. Such unrecognized codes are ignored by the control circuitry and no action is taken, unlike prior art track-based systems in which events are predetermined and predictable. In addition, the control circuitry is programmed to have an acceptance rate for detected codes such that even properly detected codes are not always acted upon. Preferably, the acceptance rate is between forty and one-hundred percent, most preferably approximately sixty percent. A less than one-hundred percent acceptance rate allows the hamster to act seemingly independently and somewhat unpredictably (like a real hamster), so that the hamster does not always perform the exact same action in response to a particular detected code. In conjunction with the coupling components (described in more detail below), the acceptance rate and ignoring of unrecognized codes add to the realism of the claimed invention, with the hamster often performing actions in response to detected codes, but sometimes "choosing" not to do so. For example, a hamster entering a garage coupling component will often (in response to a detected code upon entering the garage) engage with a car coupling component in the garage and "drive" the car (a typical response for the detected code). However, with a less than one-hundred percent acceptance rate, the control circuitry will only sometimes invoke the typical response (i.e., only sixty percent of the time). Thus, the action of the hamster in not responding identically to every encounter with a particular code results in a more intelligent appearance of its movement—sometimes it does not perform the typical or expected way, it "chooses" to ignore the code and perform different-than-expected actions. The acceptance rate and ignoring of unrecognized codes thus invoke a randomness and more realistic intelligence appearance to the actions of the motive component.

Looking once more to FIG. 4, when motive component is moving within a room component 44, there is no floor or any embedded codes. Thus, the motive component may move in a random pattern within the room, forward and backward, detecting bumping into the walls of the room via the nose bump sensor (and backing up) until it can exit the room through one of the tunnels, tubes, or other pathways connected to the room. Preferably, a pathway component portion on the entrance to the room provides an indication as to the type of room being entered (e.g., a game room) so that the control circuitry can play the appropriate sounds when the motive component enters that room. Also, a pathway component exiting the room preferably includes a bump code that signals the control circuitry to generate a new sound and/or perform different actions of the motive component as it exits.

Similar to the action of the motive component in a room as just described, the motive component can operate in a "free run" mode, apart from any pathway component. In that case, the control circuitry commands the motive component to travel in a generally straight line for predetermined time periods, then reversing. Or, the motive component could be commanded to move in an "explore" pattern similar to that depicted in FIG. 7, with the hamster moving in a short series of forward and backward motions. Preferably, the control circuitry commands that sounds be played thorough speaker 42 during free run mode.

Coupling Component

Looking to FIGS. 8-10, coupling component 82 is generally configured to mimic the appearance of a car. Coupling component 82 has a generally flat base or chassis 84 with front and side walls 86 extending upwardly from the chassis to form a frame 88. A shell 90 resembling the top, front and sides of a car is fitted over and secured to frame 88. An opening 92 is formed along the back of the coupling component having a width at least as great as the width of motive component 10 such that motive component 10 can move through opening 92 to rest on the upper surface of chassis 84. A downwardly extending ramp 94 is presented along the rear of chassis 84 to enable motive component 10 to ride up onto the upper surface of chassis 84. A slot 96 centrally located in the front of chassis 84 is configured to receive the glide pin 22 of motive component 10 when the motive component moves onto the upper surface of chassis 84. Once the guide pin 22 is positioned in aperture 90, the motive component 10 and coupling component 82 are releasably fixed together. A cut-out 98 in the rear of chassis 84 and on either side of ramp 94 is configured to enable the wheels **26*a* and 26*b* of motive component 10 to extend below the chassis such that wheels 26*a* and 26*b* are able to move both the coupling component 82 and motive component 10** in tandem. It is noted that codes similar to those described earlier may also be embedded in the coupling component to cause the motive component to take a particular action, such as moving in reverse or in a circle eight pattern or making a noise upon engaging with the coupling component.

Coupling component 82 may further include push button areas that allow activation of the control switches (e.g., switches) 20, 22, 24 on motive component by either pressing on those switches or by allowing access to those switches. For example, coupling component 82 may include a push button or resilient area corresponding to the location of control switch 20 on the motive component. That switch 20 may be activated by a user by pressing the push button or resilient area on the coupling component 82, which in turn presses switch 20. Alternatively, coupling component 82 may include one or more apertures or cut-out areas that allow access to the control switches on the motive component.

While the exemplary embodiment of coupling component 82 is depicted as a car, operable to "drive" when the hamster enters and engages as previously described, other coupling components are contemplated by, and within the scope of, the present invention. In one exemplary embodiment the coupling component is an elevator operable to move up and down when the hamster enters. The elevator's drive mechanism may be driven by the wheels of the motive component portion of the hamster, or may be separately powered and activated upon detection of the hamster entering the elevator. The elevator may be conjured in various whimsical shape, such as a carrot. The elevator coupling component may additionally include mechanical interactive components such as gates or levers that are operated by a user interacting with the coupling component.

Another exemplary embodiment of the coupling component 82 is configured as a pizza shop having a conveyor belt, ceiling fan, advertising sign, or other movable component geared together and driven by the motive component's drive wheels. This embodiment may also include levers and gates allowing mechanical interaction by a user to control the hamster entering or exiting the pizza shop.

Other exemplary embodiments of the coupling component 82 may be configured as, for example, a beauty having a movable fan inside a hair dryer, a toll booth having movable gate and movable stop-go sign, a drive-in movie having a movable conveyor belt displaying moving scenes, a helicopter with movable rotor, an airport and airplane having a movable prop, an ice cream shop having movable window scenes and releasable gumballs that fall into a slide, and a hamburger drive-in shop with movable waitresses that "skate" to the customers. In all of these embodiments, the movement of the coupling component is effected by using power from the drive wheels of the hamster, or otherwise being activated by the presence of the hamster as described above. In addition, other features are contemplated, such as the drive wheels of the hamster turning a small generator that in turn lights LEDs that provide light to various features, such as stop lights, signage, etc. on the coupling component.

The coupling components may thus derive power from the motive component (e.g., from the drive wheels or power source) to drive or move a portion of the coupling component. For example, a helicopter coupling component may have a rotor driven by the drive wheels of the motive component, or a pizza shop may have a conveyor belt driven by the drive wheels, or powered by the batteries on the motive component. In addition, the coupling components may include their own power sources and drive mechanisms that are triggered by switches or sensors activated by the motive component. For example, an ice cream truck coupling component may have its own power source to light LEDS and sound a jingle, activated by a shake switch or other detection switch. Thus, when the hamster enters the ice cream truck the switch detects the presence of the hamster (or the movement of the ice cream truck by the hamster) and activates the light and sounds. In this embodiment, the coupling component is not powered directly by the motive component, but is self-powered and simply detects movement or the presence of the motive component. Other variations and configurations will be apparent to those skilled in the art.

In another alternative embodiment, the motive component may provide no microcontroller or integrated circuits, with the drive mechanism moving the motive component along the pathways and to the coupling components, with switches on the motive component detecting obstacles or other environmental elements. In such an embodiment, the coupling component activates the various movement, sound or light features of the component based on detection of the presence of the hamster or the hamster drive wheels driving the movement of the coupling component as described above. In this less-intelligent embodiment, the motive component operates as a primarily mechanical component, moving along the pathways and to various coupling components to activate the features of the coupling components, with minimal or no intelligence embedded in the motive component.

Operation

In operation, the motive component 10, pathway component 12 and coupling component 82 of the present invention interact to provide an apparently intelligent, interactive toy resembling a pet hamster exploring its habitat and moving beyond its habitat by traveling in a car. As the motive component travels through various pathway components, bump codes formed in the pathway components are detected by bump code sensors 34*a*, 34*b* and decoded by the control circuitry. The decoded bump code is correlated to one or more desired sounds, actions, or combinations of sounds and actions, and the control circuitry commands those sounds and actions to take place. For example, the motive component 10 can drive onto the coupling component 82 to engage and move with the coupling component so as to appear to be driving the car.

The toy may comprise multiple motive components or hamsters, each having a different appearance and each being programmed to respond differently to the codes embedded in the pathway component and/or coupling component. In this manner, each of the hamsters will have its own personality and react differently to the environmental elements.

Thus, as can be seen from the above-described exemplary embodiments, the interactive intelligent toy of the present invention provides a realistic, interactive toy that appears to explore and react to its environment and habitat by responding to the codes of the various pathways, rooms, and the like that it encounters in its habitat. The overall effect of the movement and reaction to its environment gives the appearance of an actual pet hamster exploring its environment in an intelligent, interactive manner. Additional user-operable input switches also allow a user to interact with the motive component, such as by stroking the hamster's head to cause it to coo or talk.

The term "substantially", "generally", or "approximately" as used herein may be applied to modify any quantitative representation which could permissibly vary without resulting in a change in the basic function to which it is related. For example, wheels 26*a*, 26*b* are described as being approximately the same size but may permissibly vary from that if the variance does not materially alter the capability of the invention.

While the present invention has been described and illustrated hereinabove with reference to various exemplary embodiments, it should be understood that various modifications could be made to these embodiments without departing from the scope of the invention. For example, the specific drive mechanism, control mechanism and power source for the motive component can comprise any means known in the art to move, control and power the component respectively. Similarly, even thought the exemplary embodiment is directed to a motive component, it is also anticipated that the intelligent element may not have a drive mechanism, but may have a control mechanism and power source. The intelligent element may still interact with an environmental element by responding with sound, lights or other actions upon being placed in contact or proximity to the environmental element. In addition, the intelligent element may provide control and/or power to a coupling component wherein the coupling component has a drive mechanism.

It should be understood that the intelligent element or motive component could be configured to resemble different animals, people, vehicles or other characters, with the corresponding environmental elements configured to resemble related environments, habitats and objects. The intelligent element could, for example, be a fireman with a pathway component consisting of a firehouse, roads and homes and a coupling component consisting of a fire truck.

Therefore, the invention is not to be limited to the exemplary embodiments described and illustrated hereinabove, except insofar as such limitations are included in the following claims.

What is claimed and desired to be secured by Letters Patent is as follows:

1. An interactive intelligent toy, comprising:

a motive component comprising a drive mechanism including a motor operable to rotate first and second wheels in a first direction and a second direction;

control circuitry operable to control direction of rotation of said motor to thereby move said motive component in said first and second directions, wherein said motive component further includes mechanical switches operable to detect raised bumps in a surface under said motive component and to actuate to enable detection of a code associated with said raised bumps, and wherein said control circuitry is programmed to randomly implement a predetermined movement of said motive component in response to said detected code and does not direct said motive component to perform said predetermined movement in response to said detected code every time said code is detected; and, a kickstand, operable to retract when said drive mechanism rotates said wheels in said first direction such that said kickstand does not restrict movement of said wheels, and said kickstand is operable to extend when said drive mechanism rotates said wheels in said second direction to disable said second wheel such that rotation of said first wheel causes said motive component to turn in an arc shape.

2. The interactive intelligent toy of claim 1, wherein said control circuitry is operable to communicate with said drive mechanism, and wherein said control circuitry commands said drive mechanism in response to said detected code.

3. The interactive intelligent toy of claim 1, wherein said control circuitry is operable to generate a sound in response to said detected code.

4. The interactive intelligent toy of claim 1, wherein said motive component is directed by said control circuitry to perform at least one predetermined action in response to said detected code.

5. The interactive intelligent toy of claim 4, wherein said predetermined action comprises a movement action, a sound action, or combinations thereof

* * * * *